United States Patent [19]

Baker et al.

[11] 4,018,553

[45] Apr. 19, 1977

[54] CATALYTIC FLAME-TYPE GAS BURNER ASSEMBLY AND METHOD OF BURNING GAS

[75] Inventors: Nathaniel R. Baker, Los Angeles, Calif.; Frank E. Lynch, Littleton, Colo.

[73] Assignee: Mountain Fuel Supply Company, Salt Lake City, Utah

[22] Filed: May 27, 1975

[21] Appl. No.: 581,033

[52] U.S. Cl. ..... 431/7; 126/215; 431/170; 431/328

[51] Int. Cl.[2] ..... F23D 13/14

[58] Field of Search ..... 431/2, 7, 170, 326, 431/328, 329; 126/39 R, 215

[56] References Cited

UNITED STATES PATENTS

| | | | |
|---|---|---|---|
| 784,168 | 3/1905 | Malin | 431/328 |
| 784,507 | 3/1905 | Vantine | 431/328 |
| 3,223,081 | 12/1965 | Hunt | 431/328 X |
| 3,320,997 | 5/1967 | Kofink | 431/326 X |

*Primary Examiner*—Edward G. Favors
*Attorney, Agent, or Firm*—Mallinckrodt & Mallinckrodt

[57] ABSTRACT

A flame-type gas burner, having a burner head adapted to be attached to a source of supply of a fuel gas (specifically hydrogen) and one or more jet burner orifices in the head, has each jet orifice closely covered by sufficient steel wool, preferably stainless steel wool, from a mass of such wool contiguous to the burner head to significantly reduce formation of nitrogen oxides during combustion. Openings are provided in the assembly for flow of atmospheric combustion air through the mass of steel wool during burning of the gas. The gas burner itself may be any one of the many varieties of flame-type burners that are in common use for cooking, space heating and other utility purposes. A novel method of burning fuel gas is involved.

12 Claims, 7 Drawing Figures

CATALYTIC FLAME-TYPE GAS BURNER ASSEMBLY AND METHOD OF BURNING GAS

BACKGROUND OF THE INVENTION

Field

The invention is in the field of flame-type gas burners as contrasted with radiant-type gas burners.

Objectives

In the making of the invention, objectives were to minimize the formation of nitrogen oxides in the burning of hydrogen gas; to enable the quick and economical conversion of standard flame-type burners for the burning of hydrogen gas; and to enable safe and essentially pollution-free burning of hydrogen as a gaseous fuel in both permanent and mobile homes.

State of the Art

Ordinary flame type gas burners cannot be used to burn hydrogen without some modification of the burner. Since it is currently believed that hydrogen may be the gaseous fuel of the future, it is important that there be burners available for burning hydrogen and highly desirable that there be a satisfactory way of converting existing burners for the burning of hydrogen. Catalytic radiant burners of ordinary fuel gases, e.g. natural gas and propane or butane, are known and commonly used, but hydrogen is not normally employed as a fuel gas, and conventional flame-type burners are not normally catalytic. There are publications dealing, respectively, with the catalytic effect of stainless steel probes in the reduction of nitric oxides in hydrocarbon combustion gases being sampled, and there are many patents dealing in one way or another with the use of matted fibers in the catalytic burning of fuel gases.

SUMMARY OF THE INVENTION

In accordance with the present invention, a mass of steel wool, preferably stainless steel wool, is applied to a flame-type gas burner (which in itself may and usually will be of conventional construction) to be contiguous with the burner head and cover each gas jet thereof with a sufficient quantity of such steel wool to significantly reduce formation of nitrogen oxides during operation. Provision must be made in the burner assembly as so constituted for flow of surrounding atmospheric air into and through the mass of steel wool during operation of the burner. This is normally done by providing air flow openings leading into and out of the mass of steel wool. In the burning of hydrogen as a fuel gas, the usual source of primary combustion air is eliminated, as by completely closing it off. Flame burning of the gas takes place within the mass of steel wool in the presence of combustion air, as well as at exterior surfaces of the mass. Catalytic effect of the steel wool significantly reduces the formation of nitrogen oxides during the burning of hydrogen jetted thereinto.

THE DRAWING

Gas burner assemblies presently contemplated as the best mode of carrying out the invention are illustrated in the accompanying drawings, in which:

FIG. 1 is a view in top plan of a burner assembly of the invention as incorporated in a cook stove;

FIG. 2, a vertical section taken on the line 2—2 of FIG. 1;

FIG. 3, a similar vertical section, but showing the burner head and jets in elevation;

FIG. 4, a view corresponding to that of FIG. 2, but illustrating a different type of burner head and jets;

FIG. 5, a horizontal section taken on the line 5—5 of FIG. 4;

FIG. 6, an elevational view, partly in vertical axial section, of a burner assembly of the invention as incorporated in a gas furnace; and FIG. 7, a graph showing performance, with respect to the formation of nitrogen oxides, by a burner of the invention burning hydrogen gas.

DETAILED DESCRIPTION OF INVENTION AS ILLUSTRATED

There are many varieties of flame-type gas burners for different purposes. The invention may be incorporated in any of these in order to significantly reduce the formation of nitrogen oxides during the burning of hydrogen.

Flame-type gas burners normally operate at flame temperatures within a range of from about 2000° F. to about 2800° F. and produce significant quantities of nitrogen oxides which, in the case of gas stoves and other domestic appliances, are discharged into the atmosphere of the room or other enclosure in which they are operated, and, in the case of furnaces and other vented equipment, are discharged into the outside atmosphere. In either instance, the nitrogen oxides are air pollutants and contribute to the general atmospheric pollution that is causing consternation in industrialized countries.

Hydrogen gas has been looked toward as a possible answer to energy shortage problems, but cannot be burned in standard flame-type gas burners without modification of the burners. In seeking a satisfactory way of converting standard flame-type gas burners to the burning of hydrogen gas, it was found that a mass of steel wool can be used as a catalyst for the flame-burning of hydrogen as it is jetted into such mass with a draft flow of surrounding atmospheric air for combustion purposes.

Figure 1:
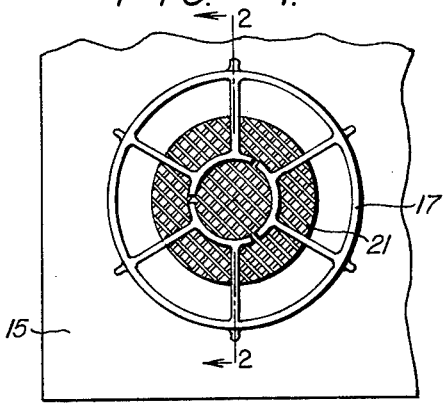
Figure 2:
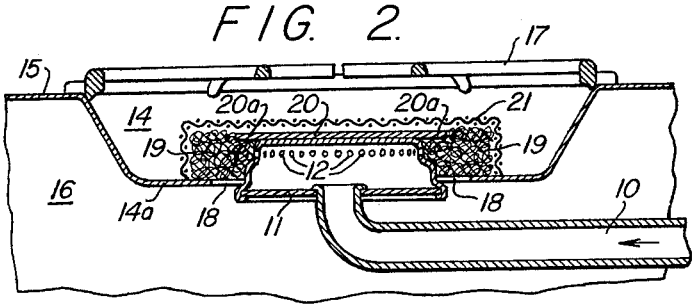
Figure 3:
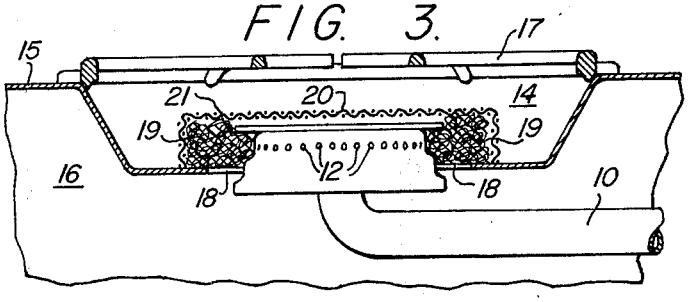

The particular flame-type gas burner of FIGS. 1, 2, and 3 is a typical gas stove burner which would be normally supplied with natural gas from a source of same to which burner pipe 10 would be connected in the usual manner through a conventional valve arrangement (not shown) enabling the introduction of controlled quantities of primary air into the gas stream flowing into and through burner pipe 10. For the burning of hydrogen, this valve is closed and covered so that no primary air is introduced into the hydrogen gas delivered to the burner head 11. In this illustrated instance, burner head 11 is circular and is provided through and around its side walls 11*a* with a series of burner jet orifices or ports 12.

Burner head 11 is positioned in the usual well 14 of the top 15 of a gas-fired kitchen range 16, and the usual pot-receiving grill 17 is provided in conventional manner. An annular draft opening 18 between burner head 11 and bottom wall 14*a* of well 14 provides for the flow of atmospheric air during operation of the burner.

In converting the conventional gas burner so far described to the burner assembly of the invention, a mass 19 of steel wool is applied to burner head 11 so as to be contiguous thereto and cover each of the burner jet orifices 12. For experimental purposes, a quick, easy, and effective way of accomplishing this conversion was found to be the use of a commercial stainless steel scrub pad pulled into generally annular shape and applied over the top of the burner head so as to surround and cover jet orifices 12 laterally as shown.

It is preferred to provide flame-deflector means above the gas jets. Here, a flame-spreading disc 20 of diameter greater than that of burner head 11 is placed on top and concentrically of burner head 11, resting on the mass 19 of steel wool. Such disc provides, in effect, an annular flange 20*a* overhanging the jet orifices 12. It is also preferred to place a grating cap, see 21, over the assembled elements to hold them in place and contribute a decorative appearance. Such grating cap may be made of metal screening.

As previously mentioned, in the burning of hydrogen gas as supplied through burner pipe 10, inflow of primary air is shut off completely so that the hydrogen is supplied to burner head 11 without admixture with air. The hydrogen is jetted through jet orifices 12 into the mass 19 of steel wool, surrounding atmospheric air being drawn through draft opening 18 and the openings of grating cap 21 for combustion purposes. The hydrogen gas supplied is preferably substantially 100% pure hydrogen.

The temperature reached by the burner head is quite low, about 450° F., due to the presence of the stainless steel wool which itself reaches a temperature of about 1100° F.

Figure 7:
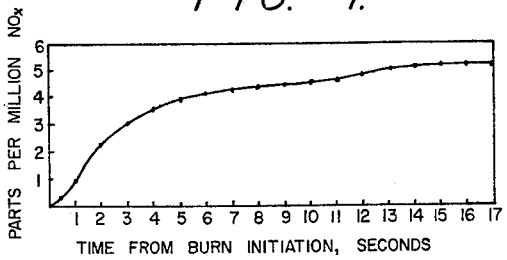

The graph of FIG. 7 was prepared from experimental results and shows maximum formation of nitrogen oxides to be about 5.25 parts per million as compared with about 150 parts per million when hydrogen was burned experimentally in the unconverted burner.

Although most flame-type gas burners are provided with a multiplicity of gas jet orifices extending around or along the burner head, depending upon the shape of the particular burner head, there are some gas stove burners having a single, very narrow, annular gas jet orifice that takes the place of an annular series of gas jet orifices, for example, of the gas jet orifices 12 in the embodiment of FIGS. 1–3. Such a burner is not preferred in the assembly of the invention for the burning of hydrogen, but it can be used if the mass of steel wool is applied to closely surround and cover the annular jet orifice in a manner similar to that indicated in FIGS. 1–3.

Figure 5:
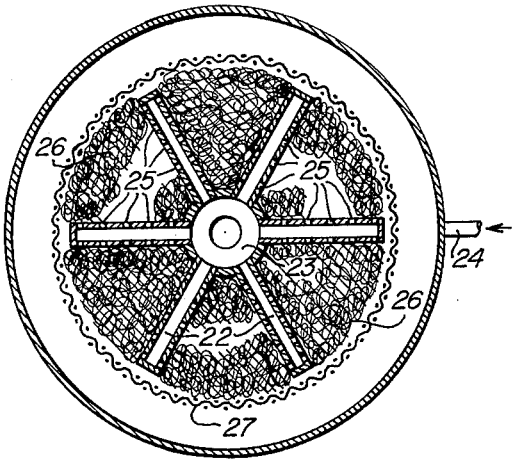
Figure 4:
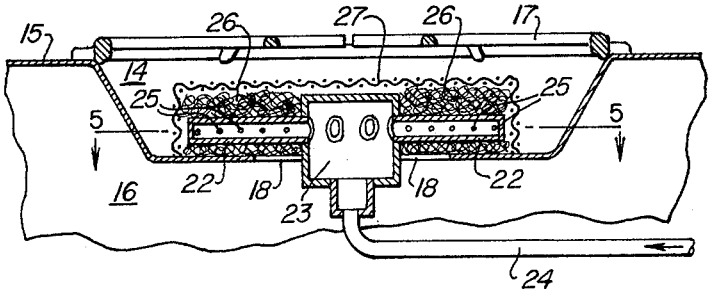

The embodiment illustrated by FIGS. 4 and 5 typifies the type of gas burner wherein arms extend radially from a central hub, including star-shaped burners. As illustrated, elongate tubes 22 extend radially from connection and flow communication with a central hub 23 that is supplied with gas by a burner pipe 24. A series of jet orifices 25 extends through the wall of and along each tube 22, the individual jet orifices thereof being supplied with gas flowing through and from hub 23. Tubes 22, whether formed as shown or as arms of star-like or similar configuration, may be considered as spokes radiating from a central hub, both spokes and hub being part of the burner head. As in the previously described embodiment, a mass 26 of steel wool is applied to and laterally of the burner head, contiguous thereto and surrounding and covering the individual jet orifices 25 with sufficient steel wool to significantly decrease the quantity of nitrogen oxides that would otherwise be formed during operation of the burner with hydrogen gas as the fuel. Also as in the previously described embodiment, a grating cap 27 is placed over the burner head and surrounding mass 26 of steel wool. It is not necessary to provide deflection means in this instance in view of the fact that the series of jet orifices 25 extend throughout the mass 26, rather than being arranged as an annulus centrally of the mass as in FIGS. 1–3.

Figure 6:
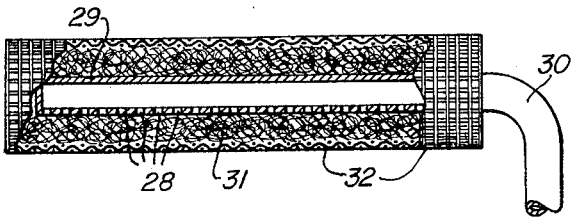

There is illustrated in FIG. 6 another embodiment of the gas burner assembly of the invention typifying standard gas burners of elongate configuration having jet orifices extending along the length of the burner head. The illustrated embodiment indicates how the invention is applied to such a burner as used in a gas furnace, but is also indicative of how the invention is applied to quite similar burners used in ovens, fireplaces, etc.

As illustrated, a series of gas jet orifices 28 extends along the bottom wall of elongate, tubular, burner head 29, which is supplied with gas by burner pipe 30. Such gas jet orifices are covered by a sufficient quantity of steel wool to significantly reduce the formation of nitrogen oxides by wrapping a mass 31 of steel wool around burner head 29. Such mass may be secured by a grating screen cover 32 or merely by wrapping a few turns of wire around the mass of stainless steel wool to hold it in place.

In variations of the elongate tube burner shown in FIG. 6, one or more series of jet orifices corresponding to the jet orifices 28 may be directed laterally or upwardly through corresponding walls of the tubular burner head. If directed upwardly, as is customary in gas ovens, the bottom of the oven immediately above the burner serves as deflecting means for gas jets.

In some utility appliances, such as gas-fired laundry dryers, an elongate, tubular, burner head, somewhat similar to the burner head 29 of FIG. 6, is provided with a single gas jet orifice at the end opposite that into which the burner pipe leads. In such instances, the mass of steel wool is placed over the open end of the burner head and either backwardly along the tube or laterally thereof a distance sufficient to provide the required quantity of steel wool for minimizing formation of nitrogen oxides. If necessary, flame-deflector means of appropriate configuration are provided to deflect the gas flame for burning within the mass of steel wool.

While ordinary steel wool is satisfactory for use in the invention, the temperature of the wool must be carefully controlled to avoid the tendency for the ordinary steel wool to oxidize relatively rapidly. Stainless steel wool is preferred for use in the invention because of its resistance to oxidation.

In general, the more steel wool utilized in connection with the burning of the gas supplied to the burner assembly, the less nitrogen oxides formed. However, there is a practical limitation based on the space available for the placement of the wool. Also, once sufficient wool has been placed about the burner to give complete combustion of the fuel gas within the wool, additional wool serves no purpose. Accordingly, the quantity of steel wool used in any given instance must be determined by the results desired, there being sufficient, however, in any given instance to significantly reduce the formation of nitrogen oxides during burning of the hydrogen gas.

In steady state burning of hydrogen gas, flash-back is not a problem with the various gas burner assemblies of the invention so long as precautions are taken to prevent introduction of air into the gas stream, either at the control valve or at the burner head. Tightly sealing the usual source of primary air will normally prevent any introduction of air into the stream of hydrogen gas going into the burner head.

Although out tests have been conducted with hydrogen gas as the fuel for the burner of the invention, it is reasonable to suppose that other fuel gases may also be burned with significant reduction in the formation of nitrogen oxides.

Whereas this invention is here illustrated and described with respect to particular embodiments thereof, it is to be understood that changes may be made therein and other embodiments constructed without departing from the novel inventive concepts set forth herein and in the claims that follow.

We claim:

1. A catalytic, flame-type, gas burner assembly, comprising a flame-type gas burner having a burner head adapted to be connected to a source of fuel gas and one or more gas burner jet orifices in said head; a mass of surface-exposed steel wool contiguous to said head as a catalyst and covering each of said gas jet orifices with a sufficient quantity of the surface-exposed steel wool to significantly reduce formation of nitrogen oxides during combustion of the fuel gas; and draft airflow passages leading into and out of the mass of steel wool to provide flow of combustion air through said mass during burning of the fuel gas therein.

2. A gas burner assembly in accordance with claim 1, wherein the steel wool is stainless steel wool.

3. A gas burner assembly in accordance with claim 1, wherein the steel wool surrounds the burner head laterally thereof, and there is additionally provided deflector means above said burner head for deflecting gas and flame laterally into said stainless steel wool.

4. A gas burner assembly in accordance with claim 3, wherein the burner head is circular and the one or more gas jet orifices are circularly arranged.

5. A gas burner assembly in accordance with claim 4, wherein there is additionally provided a grating above and laterally of the steel wool.

6. A gas burner assembly in accordance with claim 1, wherein the burner head comprises spokes radiating from a central hub and each provided with laterally-directed gas jet orifices, and wherein there is additionally provided a grating above and laterally of the steel wool.

7. A gas burner assembly in accordance with claim 1, wherein the burner head comprises an elongate tube having the gas jet orifices extending therealong, and wherein the steel wool is wrapped around said tube.

8. A gas burner assembly in accordance with claim 1, wherein the burner is sealed from entry of air into the fuel gas supplied to the burner head.

9. A method of burning a fuel gas to minimize the formation of nitrogen oxides, comprising jetting said gas into a mass of surface exposed steel wool as a catalyst; and burning said gas within said mass of steel wool while flowing combustion air through said mass.

10. A method in accordance with claim 9, wherein the fuel gas is hydrogen gas is burned in the presence of surrounding air, but without the introduction of primary air into said gas prior to the jetting thereof into the mass of steel wool.

11. A method in accordance with claim 10, wherein the steel wool is stainless steel wool.

12. A method in accordance with claim 9, wherein the steel wool is stainless steel wool.

* * * * *